United States Patent [19]

Hendrickson et al.

[11] 3,945,328

[45] Mar. 23, 1976

[54] HINGE LOCK MECHANISM FOR FOLDING TABLE LEG

[75] Inventors: Philip J. Hendrickson; Richard J. Resch, both of Green Bay, Wis.

[73] Assignee: Krueger Metal Products, Inc., Green Bay, Wis.

[22] Filed: Nov. 13, 1974

[21] Appl. No.: 523,384

[52] U.S. Cl. ..... 108/132

[51] Int. Cl.[2] ..... A47B 3/08

[58] Field of Search ..... 108/132, 131, 129, 133; 248/188, 188.1, 188.6

[56] References Cited

UNITED STATES PATENTS

| | | | |
|---|---|---|---|
| 2,075,778 | 3/1937 | Johannsen | 108/131 |
| 2,657,963 | 11/1953 | Fox | 108/131 |
| 2,860,940 | 11/1958 | DeSaussure | 108/133 |
| 3,554,141 | 1/1971 | Burr | 108/132 |
| 3,662,694 | 5/1972 | Mitchell | 108/131 |

*Primary Examiner*—Roy D. Frazier
*Assistant Examiner*—Darrell Marquette
*Attorney, Agent, or Firm*—Wheeler, Morsell, House & Fuller

[57] ABSTRACT

The crank arm of a hinge lock mechanism acts as an over-center latch for a folding leg when the leg is in its extended position perpendicular to the table top and also in its retracted position parallel to the table top. The crank arm is pivotally connected at one end to a support plate on the bottom of the table and is pivotally linked to a support arm on the folding leg. When the crank arm is rotated downwardly, it moves the folding leg far enough away from an apron or abutment so that the leg can be manually swung from its extended position to its retracted position and vice versa. The crank arm is subsequently rotated back to its upper limit in either case to latch the leg in position. The hinge lock mechanism is entirely hidden from view by aprons when the table is upright.

11 Claims, 5 Drawing Figures

HINGE LOCK MECHANISM FOR FOLDING TABLE LEG

BACKGROUND OF THE INVENTION

This invention relates to hinge lock mechanisms for folding table legs. In the past, some mechanisms of this category have been exposed to view when the table was standing upright so that there was an obvious difference between the folding table and a fixed table. Also, some of the prior art hinge lock mechanisms had appreciable play which made the folded table wobbly with respect to fixed tables.

SUMMARY OF THE INVENTION

In accordance with this invention, the foregoing disadvantages are overcome by providing a novel hinge lock mechanism including a crank arm which is pivotally connected at one end to a support plate attached to a side apron, secured to the bottom of the table and is pivotally linked to a support arm on the folding leg. The support arm is also pivotally linked to the support plate by another link. The pivot axes linking the support arm to the support plate and to the crank arm are positioned so that downward rotation of the crank arm moves the leg away from an abutment to a position in which the leg is sufficiently spaced from the abutment to be manually rotated from its extended position to its retracted position and vice versa, and upward rotation of the crank arm moves the leg toward the abutment and presses the leg against the abutment to anchor the leg in its extended position.

Further objects, advantages and features of the invention will become apparent from the following disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
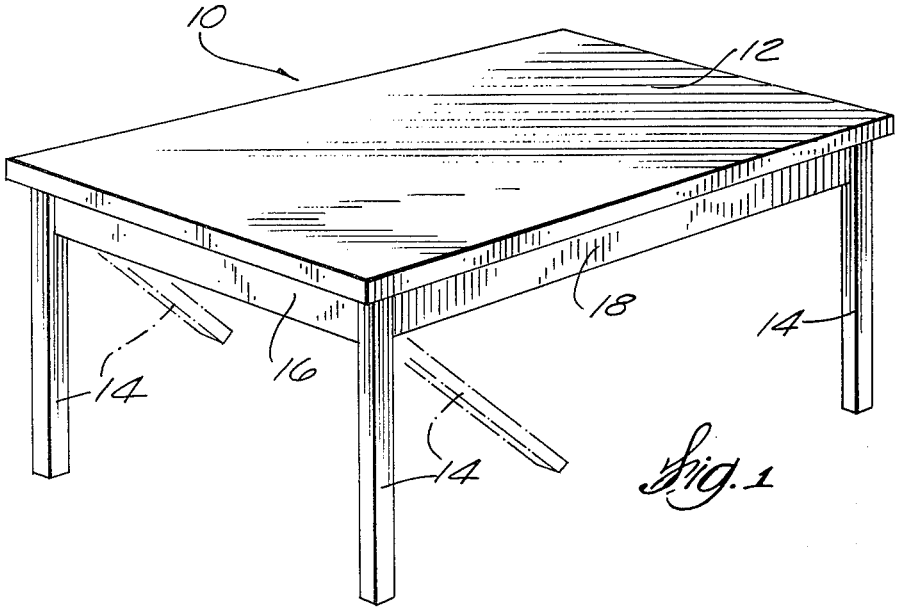
FIG. 1 is a perspective view of a folding table utilizing the hinge lock mechanism of this invention.
Figure 2:
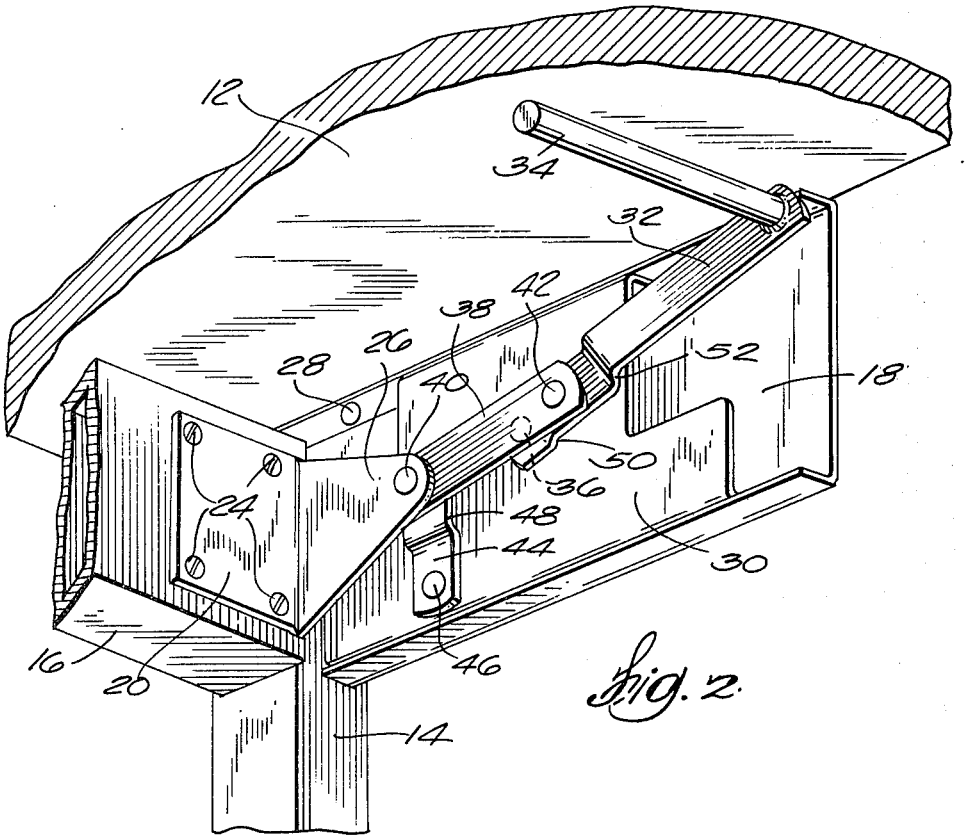
FIG. 2 is a perspective view of one embodiment of the invention as seen from below with the folding table leg latched in its extended position.

FIG. 1 shows a folding table 10 having a top 12, legs 14, which can be of any desired cross-sectional shape, end aprons 16, and side aprons 18. The legs and aprons can be constructed of stainless steel or metal extrusions. One important advantage of the hinge lock mechanism of this invention is that it can be completely concealed under aprons 16 and 18 when the folding table 10 is in upright position for use as shown in FIG. 1 so that the folding table 10 looks like a table with fixed legs. FIG. 2 is a perspective view of an embodiment of the hinge lock mechanism of this invention as seen from below.

Referring to FIGS. 1 and 2, in this embodiment of the invention, the legs 14 are rigidly attached to the adjacent ends of end aprons 16, which move together with the corresponding legs 14. This is not a necessary feature of the invention, since end aprons 16 could be fixed rather than movable if desired. In this particular embodiment, leg 14 and end apron 16 are joined together by a right angle bracket 20 (FIG. 2) which is welded at 22 (FIG. 3) to leg 14 on one side and is attached by rivets 24 (FIG. 2) to apron 16 on the other side. A support arm 26 (FIG. 2) is also welded to leg 14 at 22 (FIG. 3) and projects transversely from leg 14.

Side apron 18 is attached to the bottom of table top 12 by screws 28 or the like and has a support plate 30 welded thereto beside the end of support arm 26. Apron 18 extends downwardly below the bottom margin of support plate 30 to hide the same from view. A crank arm 32 having a handle 34 on one end is pivotally connected to support plate 30 by a pivot pin 36 and can be rotated upwardly and downwardly about the axis defined by pivot pin 36. Crank arm 32 is linked to the end of support arm 26 by a link 38 which is pivotally connected at one end by pivot pin 40 to the inner end of support arm 26 and is pivotally connected at the other end by pivot pin 42 to crank arm 32. The inner end of support arm 26 is also pivotally linked to support plate 30 by a second link 44 which is pivotally connected at one end to support arm 26 by pivot pin 40 and which is pivotally connected at the other end to support plate 30 by pivot pin 46. Link 44 is offset inwardly at 48 and crank arm 32 is offset inwardly at 50 so that link 38 will clear the head of pivot pin 36 so as to provide unobstructed movement of link 38. Crank arm 32 is also offset inwardly at 52 to prevent arm 32 from obstructing the movement of leg 14 when it is moved from its extended position perpendicular to table top 12 to its retracted position parallel to table top 12.

Figure 3:
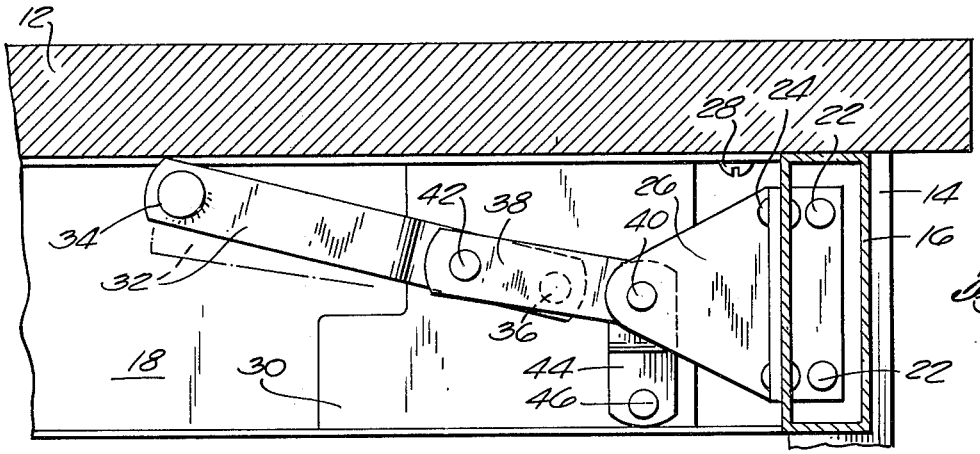
FIG. 3 is a side elevation view of the embodiment of FIG. 2 with the folding table leg latched in its extended position.
Figure 4:
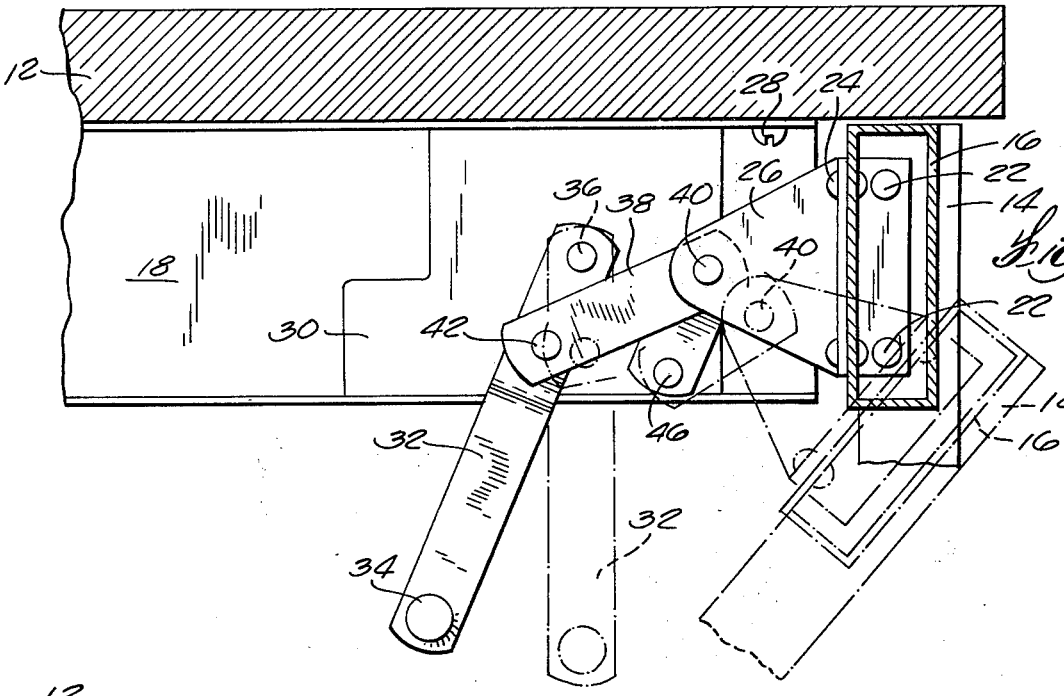
FIG. 4 is a side elevation view of the embodiment of FIG. 2 with the crank arm moved to its lower position.
Figure 5:
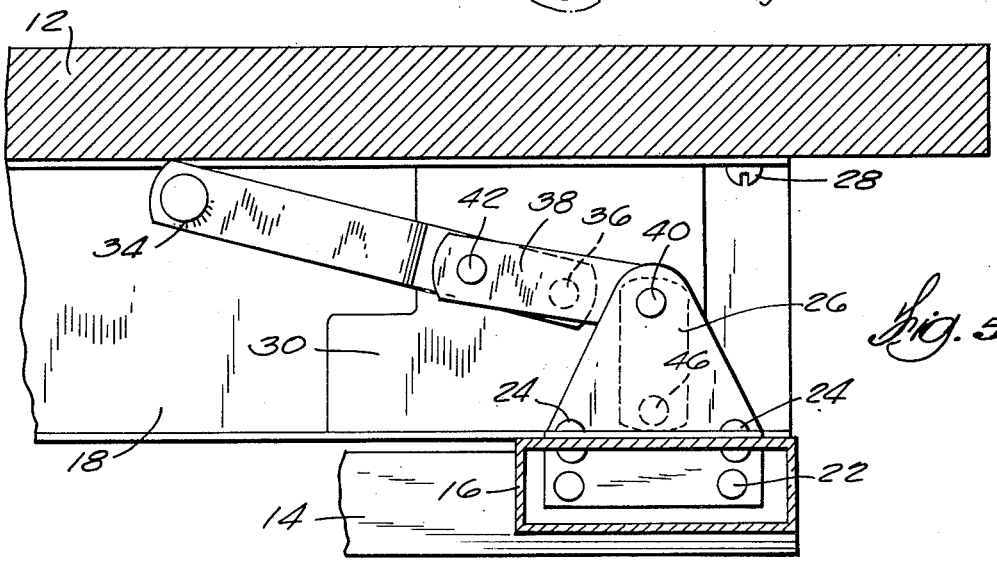
FIG. 5 is a side elevation view of the embodiment of FIG. 2 with the folding table leg latched in its retracted position.

The axes of pivot pins 36, 40, 42, and 46 are positioned as best shown in FIGS. 3, 4, and 5 to enable crank arm 32 to be used as an over-center latch when leg 14 is in its extended position (FIG. 3) and when leg 14 is in its retracted position (FIG. 5). Pivot pins 36, 40, 42, and 46 are also positioned to enable leg 14 to be easily manually moved between its extended and retracted positions when crank arm 32 is rotated downwardly to the unlatched position shown in FIG. 4. As crank arm 32 is rotated downwardly, the downward rotation moves leg 14 away from the end 54 (FIG. 4) of side apron 18 to a position in which leg 14 is sufficiently spaced from end 54 to be manually rotated from its extended position (FIG. 3) to its retracted position (FIG. 5) and vice versa. The dotted lines in FIG. 4 show an intermediate position in which leg 14 is approximately half way between its extended and retracted positions.

When crank arm 32 is rotated upwardly from the position shown in solid lines in FIG. 4, the mechanical advantage of crank arm 32 is used to draw leg 14 solidly against the abutment formed by the end 54 of side apron 18. The mechanical advantage of crank arm 32 stems from the fact that the distance from pivot pin 36 to pivot pin 42 is less than the length of crank arm 32. Therefore, a force applied to the end of crank arm 32 develops a greater force at pivot pin 42. Link 38 is of such length that it applies inward pressure to leg 14 to press it against end 54 of side apron 18 when crank arm 32 and leg 14 are in the position shown in FIG. 3. This provides a solid leg connection without wobble. Pivot pins 36, 40, 42, and 46 are positioned to provide an over-center latching action for latching leg 14 in position. To accomplish this, pivot pins 36, 40 and 42 are positioned so that they will lie along a straight line shortly before crank arm 32 reaches it upper limit of rotation and will move out of linearity as crank arm 32 continues to its upper limit of rotation, thereby providing an over-center latching action. The dotted lines in FIG. 3 show the position of crank arm 32 at which pivot pins 36, 40 and 42 form a straight line, and the solid lines in FIG. 3 show the upper limit of rotation of crank arm 32 at which position pivot pins 36, 40 and 42 are moved slightly out of linearity. As shown in FIG. 5, the over-center latching action of crank arm 32 also works when leg 14 is in its retracted position parallel to the table top 12.

It should be noted in FIGS. 3, 4, and 5 that leg 14 does not rotate about a fixed pivot axis but rather rotates about a movable axis defined by pivot pin 40, which moves in a circular arc around pivot pin 46 as crank arm 32 is rotated between its upper position (FIG. 3) and lower position (FIG. 4). The movable pivot axis for leg 14 is an important feature of this invention since it enables leg 14 to be firmly locked against the end 54 of side apron 18 in the extended position of leg 14 and yet to be swung clear of end 54 when leg 14 is moved from its extended to its retracted positions as shown by the dotted lines in FIG. 4.

To move leg 14 from its extended position (FIG. 3) to its retracted position (FIG. 5), crank arm 32 is rotated from its upper position (FIG. 3) to its lower position (dotted lines in FIG. 4). This moves leg 14 far enough away from the end 54 of side apron 18 so that it can be manually swung from its extended to its retracted position (FIG. 5). Crank arm 32 is then moved back to its uppermost position to latch leg 14 in its retracted position as shown in FIG. 5. In this particular embodiment of the invention, end apron 16 moves the leg 14 and also moves the leg 14 on the opposite end of apron 16. The other leg 14 has a hinge lock mechanism (not shown) identical with that described above which is moved in synchronism with the hinge lock described above when legs 14 are being swung from their extended to their retracted position or vice versa. However, it is not necessary to tie two legs 14 together with end apron 16. If desired, end aprons 16 can be attached to the bottom of table top 12 and legs 14 can be free to move independently and to be latched in their extended or retracted positions by their respective hinge lock mechanisms.

To move leg 14 from its retracted position (FIG. 5) to its extended position (FIG. 3), crank arm 32 is first moved from its upper position to the lower position shown in dotted lines in FIG. 4. Legs 14 and end apron 16 are then manually rotated from the retracted position (FIG. 5) to the position shown in solid lines in FIG. 4, and crank arm 32 is then rotated to its uppermost position to draw leg 14 against the end 54 of side apron 18 and latch it thereagainst.

As used in the specification and claims, "upward" rotation of crank arm 32 means rotation of crank arm 32 toward table top 12 regardless of whether the table is right side up or upside down. "Downward" rotation of crank arm 32 similarly means rotation away from table top 12.

What is claimed is:

1. A table construction comprising a table top, an abutment attached to said table top, a leg, means for connecting said leg to said table top for movement between an extended position perpendicular to the table top and a retracted position parallel to the table top, said means including a crank arm, first pivot means connecting said crank arm to said abutment, a first link, second pivot means connecting said first link to said leg about which said leg can be pivoted from its extended to its retracted position and vice versa, and including a second link connected at one end to said second pivot means, a third pivot pivotally connecting said first link to said crank arm at a point spaced from said first pivot, and a fourth pivot connecting said second link to said abutment with said crank arm being movable between a first position in which said leg is secured against abutment and said second link is secured against movement and a second position in which said leg is free from said abutment and said second link is movable about said fourth pivot to afford movement of said leg between its extended and retracted positions.

2. A hinge lock mechanism for a folding table leg which is pivotable between an extended position perpendicular to the top of said table and a retracted position parallel to the top of said table, said hinge lock mechanism comprising a support arm rigidly attached to said leg near the top thereof and extending inwardly therefrom, a support plate rigidly attached to the bottom of said table near said leg and extending downwardly therefrom adjacent to said support arm, an abutment attached to the bottom of said table top near said leg, a crank arm pivotally attached to said support plate about a first pivot axis, a first link pivotally attached at one end to the inner end of said support arm about a second pivot axis and pivotally attached at the other end of said crank arm about a third pivot axis, and a second link pivotally attached at one end to said support arm and said first link about said second pivot axis and pivotally attached at the other end to said support plate about a fourth pivot axis, said pivot axes being so located that downward rotation of said crank arm moves said leg away from said abutment to a position in which the leg is sufficiently spaced from said abutment to be manually rotated from its extended position to its retracted position and vice versa, and upward rotation of said crank arm moves said leg toward said abutment and into contact with said abutment when the leg is in its extended position.

3. The hinge lock mechanism of claim 2 and further comprising a first apron attached to the bottom of said table top adjacent to said support plate and extending downwardly below the bottom margin of said support plate, and a second apron attached to the bottom of said table top adjacent to one side of said leg and oriented at right angles to said first apron, said second apron extending downwardly to the same level as said first apron whereby said hinge lock mechanism is hidden from normal view by said aprons when the table is upright with the legs thereof in their extended position and said crank arm in its uppermost position.

4. The hinge lock mechanism of claim 3 wherein said abutment comprises the end edge of said first apron adjacent to said leg.

5. The hinge lock mechanism of claim 2 wherein said first, second, and third pivot axes are positioned so that they will lie along a straight line shortly before said crank arm reaches its upper limit of rotation and will move out of linearity as the crank arm continues to its upper limit of rotation, thereby providing an over-center latching action.

6. The hinge lock mechanism of claim 2 wherein said first link is dimensioned to cause said leg to press against said abutment as said crank arm is pivoted toward its upper limit of rotation, thereby firmly anchoring said leg to said abutment and preventing the leg from wobbling.

7. The hinge lock mechanism of claim 2 wherein the distance from said first pivot axis to said third pivot axis is less than the length of said crank arm whereby a force applied to said crank arm to move the same upwardly causes a larger force to be applied to said leg due to the mechanical advantage of said crank arm.

8. The hinge lock mechanism of claim 4 wherein said support plate is attached to said first apron and wherein said leg is attached to said second apron.

9. The hinge lock mechanism of claim 2 wherein said crank arm and said second link are offset inwardly to space said first link inwardly from the pivoted end of said crank arm to permit free movement of said first link.

10. The hinge lock mechanism of claim 2 wherein said fourth pivot axis is located below said first pivot axis and said second link is transverse to said first link.

11. The hinge lock mechanism of claim 6 wherein said first, second, and third axes are positioned so that they will lie along a straight line shortly before said crank arm reaches its upper limit of rotation and will move out of linearity as the crank arm continues to its upper limit of rotation, thereby providing an over-center latching action.

* * * * *